US005505762A

United States Patent [19]

Denholm et al.

[11] Patent Number: 5,505,762

[45] Date of Patent: Apr. 9, 1996

[54] LANCE FOR IMMERSION IN A PYROMETALLURGICAL BATH AND METHOD INVOLVING THE LANCE

[75] Inventors: William T. Denholm, Camberwell; Robert N. Taylor, Emerald, both of Australia

[73] Assignee: Commonwealth Scientific and Industrial Research Organisation, Campbell, Australia

[21] Appl. No.: 133,162

[22] PCT Filed: Apr. 23, 1992

[86] PCT No.: PCT/AU92/00182

§ 371 Date: Nov. 22, 1993

§ 102(e) Date: Nov. 22, 1993

[87] PCT Pub. No.: WO92/18819

PCT Pub. Date: Oct. 29, 1992

[30] Foreign Application Priority Data

Apr. 23, 1991 [AU] Australia ..... PK5785/91

[51] Int. Cl.[6] ..... C21C 5/32

[52] U.S. Cl. ..... 75/641; 75/655; 266/44; 266/225

[58] Field of Search ..... 266/225, 44; 75/707, 75/640, 641, 655

[56] References Cited

U.S. PATENT DOCUMENTS

| | | | |
|---|---|---|---|
| 3,802,681 | 4/1974 | Pfeifer . | |
| 3,828,850 | 8/1974 | McMinn et al. . | |
| 4,023,676 | 5/1977 | Bennett et al. . | |
| 4,251,271 | 2/1981 | Floyd | 266/225 |
| 4,891,064 | 1/1990 | Umezawa et al. . | |
| 5,251,879 | 10/1993 | Floyd | 266/225 |
| 5,308,043 | 5/1994 | Floyd et al. | 266/225 |

*Primary Examiner*—Melvyn Andrews
*Attorney, Agent, or Firm*—Bacon & Thomas

[57] ABSTRACT

A method for submerged injection of materials into a liquid pyrometallurgical bath by means of a lance, characterised in that a first gas consisting of or containing oxygen is conveyed to said bath along a first path within the lance, a combustible fluid is conveyed to said bath along another path within the lance, and a further gas consisting of or containing oxygen is conveyed to said bath along a further path within the lance, the first path being arranged so that the first gas acts as a coolant for the lance. A lance for submerged injection of materials into a liquid pyrometallurgical bath, comprising an outer end portion to be submersed in the bath, an outer lengthwise extending tubular member, an inner lengthwise extending tubular member positioned within the outer tubular member, an annular duct being thereby defined between the outer and inner tubular members for conveying a gas consisting of or containing oxygen to an open outer end thereof, a conduit positioned within and extending lengthwise of the inner tubular member for conveying further gas consisting of or containing oxygen to the outer end portion of the lance, a lengthwise passage being thereby defined between the inner tubular member and the conduit for conveying combustible fluid to the outer end portion of the lance, at least one port providing communication between the passage and the annular duct and at least one exit passageway providing communication between the conduit and the annular duct at a location downstream of the port or ports, for directing the further gas flowing from the conduit into the annular duct.

34 Claims, 3 Drawing Sheets

LANCE FOR IMMERSION IN A PYROMETALLURGICAL BATH AND METHOD INVOLVING THE LANCE

Figure 1:
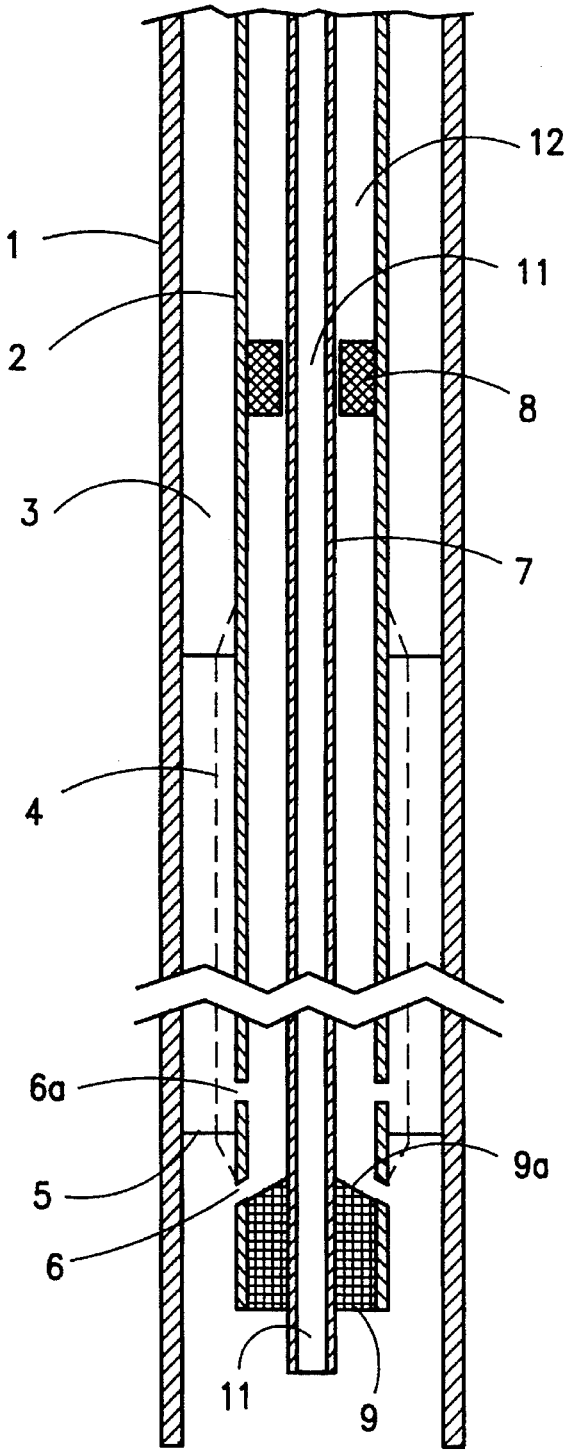

This invention relates to a lance for immersion in a pyrometallurgical bath and a method involving the lance.

In carrying out a bath smelting operation, it is necessary to inject fuel with air or oxygen enriched air below the surface of the bath to achieve both heating of the bath and mixing by means of the turbulence created by the passage of gas bubbles through the bath. Injection of the gas and fuel may be achieved by three main methods, namely:

(1) using side blown tuyeres as in the Pierce-Smith converter or the zinc slag fuming furnace, (2) bottom entry tuyeres, usually of the hydrocarbon shrouded Savard-Lee injector type, or (3) through top entry lances which must be cooled to prevent burning away of the tip of the lance.

In the Mitsubishi process a steel lance is located at the surface of the slag bath and is allowed to burn away at a slow rate while it is fed into the bath from above and rotated to ensure even wear.

The above described prior art processes are "submerged combustion" processes. As an alternative to submerged combustion, a water cooled lance may be located above the level of the bath, and air or oxygen (with or without fuel) may be blown at supersonic velocity into the bath as in the LD oxygen steel making process.

One form of submerged combustion lance is described in U.S. Pat. No. 4,251,271. This employs cooling by means of the air used for combustion of the fuel. In this case the dimensions of the lance are arranged so that the gas flow rate and the velocity of flow through the lance tube cause a layer of slag to solidify on the outer surface of the lance and protect it from attack by the bath. In this type of lance a swirler is used to increase the gas velocity and enhance the heat transfer through the wall to the flowing gas. The swirler also serves the purpose of improving the mixing between the air and the fuel which is delivered through a central pipe. While this type of lance has been used successfully in a number of bath smelting applications, it suffers from a number of disadvantages.

Thus, to achieve the required heat transfer near the tip of the lance, the gases are accelerated up to velocities approaching Mach 1. When attempts are made to force the air to flow at a higher rate the spiral passages in the swirler behave as choked ducts. A very large increase in pressure is then necessary to compress the gas and achieve higher mass flow rate. Flexibility and turndown with this lance is limited by the necessity to maintain a minimum flow down the lance to ensure adequate cooling. Again, because the combustion air is the coolant for this lance, it is not possible to enrich this air with oxygen much above 35% oxygen, since with higher oxygen contents the tip of the lance may burn away.

Broadly speaking, in the present invention these limitations are at least lessened by using an annular duct through which cooling air flows at sufficiently high mass flow rate and velocity to cool an outer lance tubular member.

According to one aspect of the present invention there is provided a lance for submerged injection of materials into a liquid pyrometallurgical bath, comprising an outer end portion to be submersed in the bath, an outer lengthwise extending tubular member, an inner lengthwise extending tubular member positioned within the outer tubular member, an annular duct being thereby defined between the outer and inner tubular members for conveying a gas containing oxygen to an open outer end thereof, a conduit positioned within and extending lengthwise of the inner tubular member for conveying further gas consisting of or containing oxygen to the outer end portion of the lance, a lengthwise passage being thereby defined between the inner tubular member and the conduit for conveying combustible fluid to the outer end portion of the lace, at least one port providing communication between the passage and the annular duct and at least one exit passageway providing communication bet-ween the conduit and the outer end portion of the outer tubular member at a location downstream of the port or ports, for directing the further gas flowing from the conduit into the outer end portion of the lance.

According to another aspect of the invention, there is provided a method for submerged injection of materials into a liquid pyrometallurgical bath by means of a lance, characterised in that a first gas or containing oxygen is conveyed to said bath along a first path within the lance, a combustible fluid is conveyed to said bath along another path within the lance, and a further gas containing at least 35% oxygen is conveyed to said bath along a further path within the lance, the first path being arranged so that the first gas acts as a coolant for the lance.

According to a further aspect of the present invention there is provided a method for injecting materials into a liquid pyrometallurgical path, characterised in that the lance as described above is positioned so that the outer end portion of the lance is submersed in the bath and the gas containing oxygen, the further gas consisting of or containing oxygen and the combustible fluid passed along the lance, through the annular duct, and through the conduit and the lengthwise passage, respectively to exit at the outer end portion of the lance.

The annular duct may be divided near the open outer end thereof to form a plurality of duct portions. The plurality of duct portions may be provided by at least two radial baffles extending between the inner and outer tubular members. Preferably, the at least two radial baffles are in spiral form thereby to impart swirl to the gas flowing within the annular duct.

The term "combustible fluid" as used herein will be understood to include (but not be limited to) combustible gases, such a natural gas or other gaseous fuels; vaporising fuels, such as oils or liquefied petroleum gas; and particulate solid or liquid fuels, such as oil or pulverised coal entrained in a carrier gas.

Preferably, when carrying out the method of the invention, the combustible fluid is passed through the lengthwise passage for exit therefrom via said port(s). The port or ports may be in the form of a hole or a slot, preferably located substantially within 1000 mm from the open outer end of the annular duct. When more than one port is present these may be spaced around the circumference of the annular duct.

In one form of the lance the lengthwise passage may be terminated at its outer end by a closure (through which the conduit passes) with the combustible fluid passing through radial ports into the annular duct. Alternatively, the lengthwise passage may be a partial closure with axial ports providing outflow of fluid directly into the outer portion of the outer tubular member.

The conduit may extend through the closure or partial closure so as to provide outflow of further gas through its open end or alternatively through exit passageways. Preferably, the pen end of the conduit may terminate at a location not more than substantially at a distance equal to one outer tubular member diameter upstream and three diameters downstream of the open end of the outer tubular member, or alternatively exit passageways may be located within a distance equal to three diameters past the end of the outer tubular member.

Typically, the gas employed in using the lance is air. The gas pressure may be in the range 50 to 100 kPa. This may be supplied by a suitable blower while "turn up" is achieved by burning additional fuel with a relatively small volume of additional oxygen delivered through said conduit near the open outer end of the annular duct. In another embodiment, liquid fuel may be delivered through the lengthwise passage and at least one port provided with an atomising nozzle.

By introducing some or all of the oxygen separately through the conduit it is possible to achieve higher levels of enrichment. The extent to which enrichment is possible depends on the scale of the operation and the application. However, it will be appreciated that small diameter lances (25 mm diameter) have been operated with effective oxygen enrichment levels of 70%.

Conveniently, the inner and outer tubular members are coaxial and the conduit may likewise be coaxial with the inner tubular member. The lance may be composed of steel at the outer portion of the lance to be submerged in the bath, preferably stainless steel. In use, a solidified slag layer forms on the lance. The dimension of the annular duct is preferably such that the required cooling air flow rate can be achieved at low supply pressures, typically not exceeding 100 kPa as described above.

When the aforementioned additional fuel is required, in excess of that which can be burned with the supplied quantity of air, the additional oxygen is injected through the conduit into a stream of fuel and air at a location close to the axis of the lance and close to the open end of the lance so that it does not mix completely with the fuel/air mixture in the short time lapse before the mixture passes through the open end of the lance. Contact between strongly oxygen enriched air and the outer tubular member can therefore be avoided, but the oxygen is available for combustion in the flame immediately beyond the lance tip. Thus, the lowest heat input to the bath can be achieved by burning fuel in the air flowing from the annular duct at the minimum rate necessary to form the protective slag layer. The described "turn-up" to higher heat input, achieved by burning additional fuel with oxygen, is effected without increasing the flow of cooling air (and therefore the supply pressure).

According to a still further aspect of the present invention there is provided a lance for immersion into a liquid pyrometallurgical bath, comprising an outer tubular member, an inner tubular member which is concentric with the outer tubular member, a conduit being located within the inner tubular member, an annulus being defined between the outer and inner tubular members, said annulus being open at an outer end thereof and through which air flows at a sufficiently high flow rate and velocity past an inner surface of the outer tubular member to cool the outer tubular member and to cause a protective layer of the liquid in the bath to solidify on said outer tubular member, the annulus being divided near the open outer end into a plurality of ducts by means of at least two radially extending baffles.

Figure 1B:
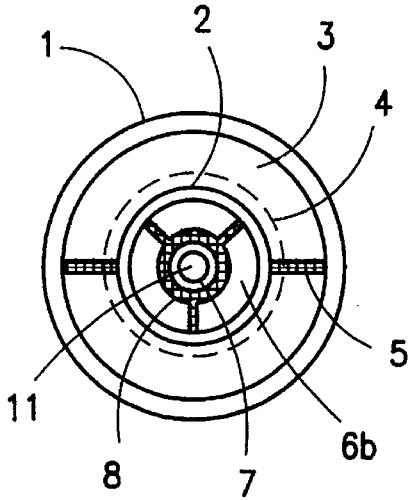
Figure 1A:
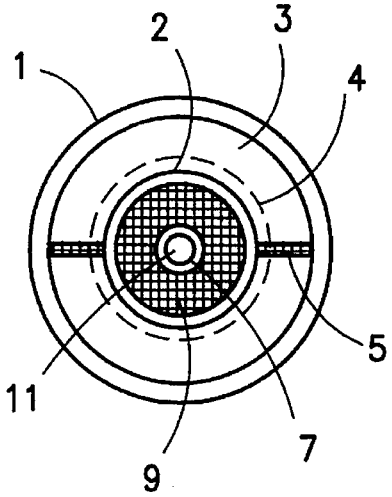
Figure 2:
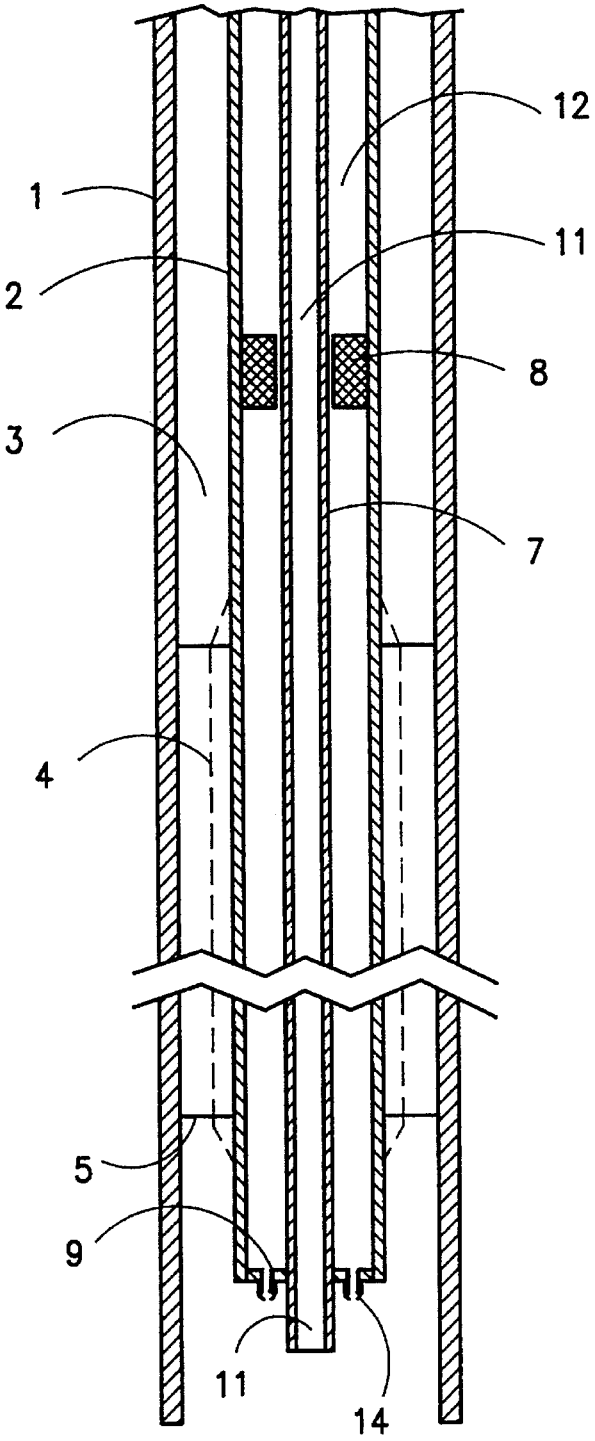
Figure 2A:
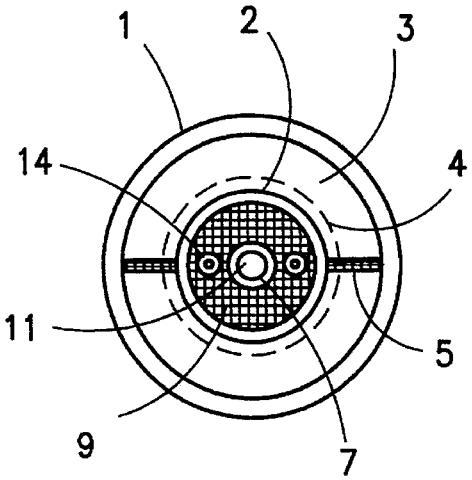
Figure 3:
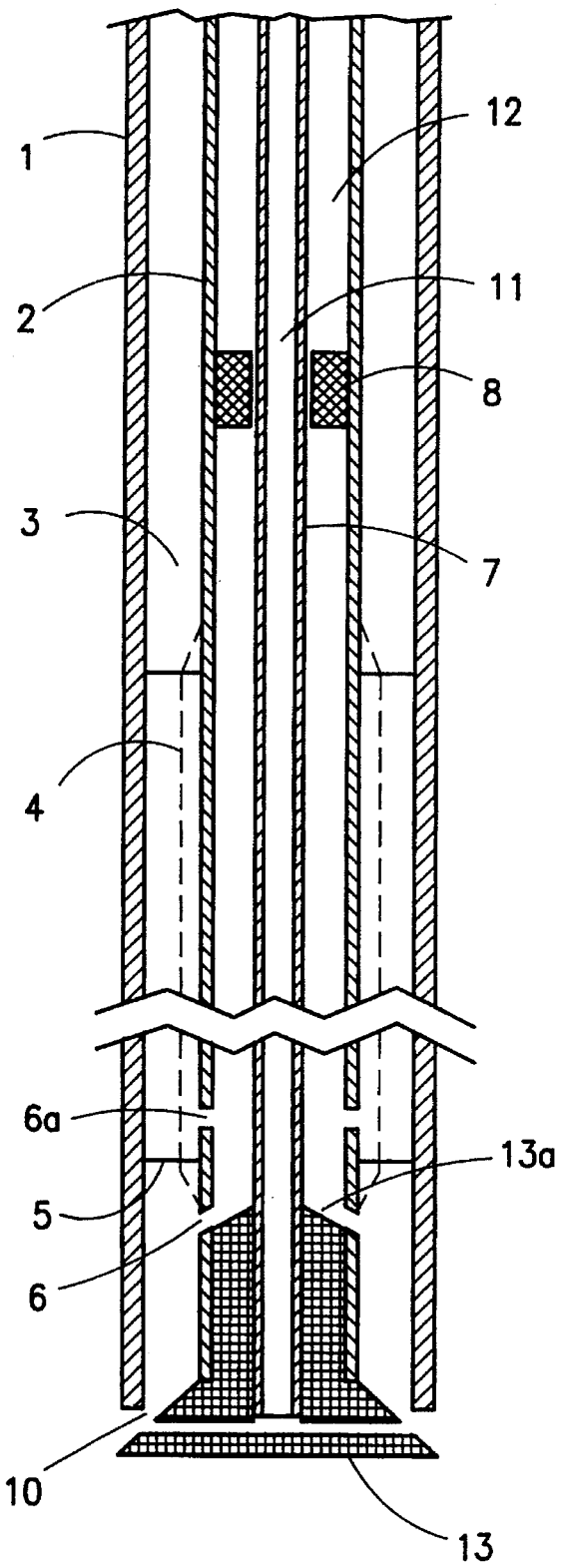
Figure 4:
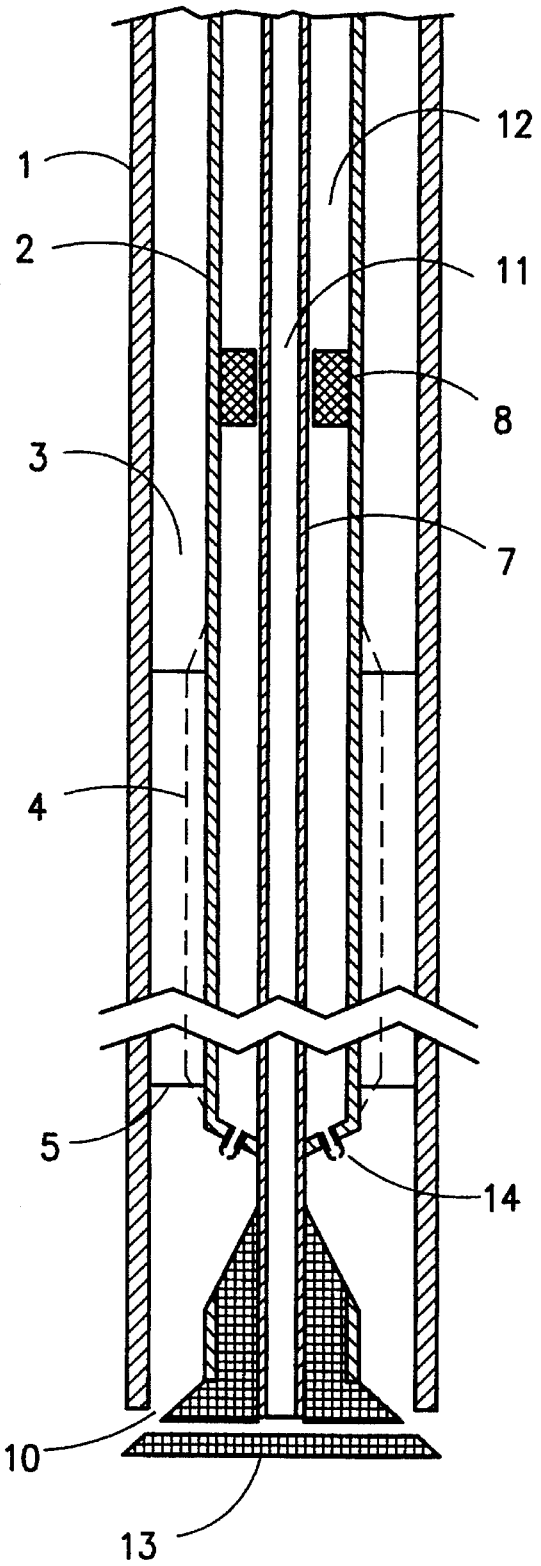

An embodiment of the invention will now be described by way of example only with reference to the accompanying drawings in which:

FIGS. 1 and 2 are fragmentary cross-sectional views of a lance according to the present invention while FIGS. 1*a*, 1*b* and 2*a* show end views; and FIGS. 3 and 4 are fragmentary views as in FIGS. 1 and 2, but showing a modified form of a lance according to the present invention.

A coaxial outer tubular member 1 and inner tubular member 2 form an annular duct 3 through which air for cooling and partial combustion flows. The flow is downwardly as shown in the drawings towards an outer end portion of the lance. In use, the outer end portion of the lance is submerged in the bath.

At the outer end portion of the lance, the inner tubular member 2 is supported by baffles 5 from the outer tubular member 1. A conduit 7 is positioned coaxially within inner tubular member 2 so as to define an lengthwise passage 12 between the inner surface of the inner tubular member 2 and the outer surface of the conduit. The conduit is secured in position by means of members 8 and 9 which provide attachment between the inner tubular member and the conduit. The member 9 is located at the lower end portion of the inner tubular member 2.

The member 9 is of annular form, substantially closing or partially closing the inner tubular member 2 at its lower end. The conduit 7 extends coaxially through the member 9 so as to provide for outflow of further gas through the end of the conduit 11 which is located a short distance below the lower surface of the member 9.

The baffles 5 may be of spiral form to impart swirl to air moving within the annular duct 3 or may be straight baffles which terminate in a short spiral portion.

Ports 6, in the form of holes or slots extend through the side wall of the inner tubular member 2. Two alternative positions are indicated—6 is at the lower end of 2 and immediately above member 9 while 6*a* allows entry of fuel into the swirler region aroúnd tubular member 2. By appropriate choice of the size of the holes and slots and the position within the swirler region it is possible to regulate a) the proportion of fuel entering the swirler region; and b) the extent of mixing.

By such means, it is possible to regulate the intensity of combustion. In FIG. 1*b* parts 6*b* are also shown which extend axially through member 9 in order to provide for outflow from the tubular member 2. Ports 6*a* and 6*b* may be provided instead of or additionally to port 6. In the lance of FIGS. 1*a* and 3, the ports 6*b* are not provided, only ports 6 and/or 6*a*.

Powdered coal transported by carrier gas flows down the lengthwise passage 12 into oxygen containing gas which passes down the annular duct 3. This inflow occurs via the ports 6, 6*a* and/or 6*b*. Oxygen is delivered through the conduit 7 to emerge into the outer end of member 13 via the end of the conduit 11 as shown in FIGS. 1 and 2 and/or the exit passageways 10 as shown in FIGS. 3 and 4 at locations downstream of the locations at which the carrier gas and powdered coal emerge from the ports 6, 6*a* or 6*b*. An atomizing nozzle 14 may also be provided in at least one port so as to deliver fuel through the lengthwise passage 12.

The inner tubular member 2 may have an enlarged portion towards the outer end of the inner tubular member as indicated by broken lines 4 of FIGS. 1 to 4.

To assist the flow from the lengthwise passage 12 into the annular duct 3, the member 9 may have a frusto-conical upper surface 9*a* and the ports 6 may be angled as viewed in cross-section so as to correspond with an angle of the frusto-conical upper surface of the member 9.

As shown in FIGS. 3 and 4, the member 9, shown in FIG. 1, may also have a further frusto conical surface portion at its lower end to form a further member 13 which projects across the open outer end of the annular duct 3 at a location below an end of the outer tubular member 1. By this arrangement, lateral momentum is imparted to gases leaving the tip of the lance. The further member 13 may also have a frusto-conical upper surface 13*a*. In FIGS. 3 and 4, the outer end of the conduit 7 is closed by further member 13 and outflow from the conduit 7 occurs through exit passageways 10 through further member 13. Provision could also be made for outflow from conduit 7 via the end of the conduit 11 as in the lance of FIGS. 1 and 2. Alternatively, the lance of FIGS. 1 and 2 may he provided with an exit passageway 10 as shown in FIGS. 3 and 4.

The general operation of the lance as shown is as follows:

1. Combustible gas, or finely divided coal conveyed by carrier gas, is passed through the lengthwise passage 12 within the inner tubular member 2 and is delivered into the high velocity air stream flowing in the annular duct 3 (which duct is divided by baffles 5) through the circumferential ports 6 or **6*a* at a location substantially within 1000 mm from the open outer end of the annular duct 3 or alternatively through the axial ports 6*b***.
2. Oxygen is conveyed through the conduit 7 in the inner tubular member 2 and is injected through the exit passageways 10 (FIGS. 3 and 4) or 11 (FIGS. 1 and 2) into the stream of air and fuel at a location preferably downstream of the injection points of coal fuel.
3. The inner tubular member 2 forming the annular duct 3 preferably terminates at a location which may vary between one meter inside the open end of the outer tubular member and several outer tubular member diameters beyond the end of the outer tubular member.
4. The lance may be operated at an air pressure which may typically be as low as 50–100 kPa which can be supplied by a blower, while "turn-up" is achieved by burning additional fuel with a relatively small volume of oxygen delivered near the outer end portion of the lance.
5. In another embodiment of the lance shown in FIGS. 2 and 4, liquid fuel may be delivered through atomising nozzles into the high velocity air stream.

As described above, the inner tubular member 2 forming the annular duct may have an enlarged portion as identified by broken lines 4. This enlargement may be for distance of up to 2 meters from the outer end of the inner tubular member and may serve to decrease the annular area of annular duct 3 and to impart high velocity to the gases flowing through the annular duct, the enlargement being such that at the highest air flow rate at which the lance is operated the velocity increases from approximately 100 meter/see in the wide annular section in the upper portion of the lance to approximately Mach 0.9 in the reduced annular duct at the open end of the outer tubular member 1.

Alternatively, all or part of the increase in velocity towards the open outer end of the annular duct may be achieved by shaping the radially extending baffles 5 into spirals also as discussed above for all or part of their length. This imparts swirl to the gases flowing from the lance and therefore enhances mixing between the air, combustible fluid and oxygen. The swirl angle is preferably designed so that the helical velocity does not exceed Mach 0.9 and generally it is preferred that the swirl angle of the or each radial baffle is such that choked flow is avoided and low pressure operation is attained. However, in operation it is possible to raise the supply pressure to achieve choked flow operation in which the helical velocity reaches Mach 1.

The main purpose of the increase in velocity towards the outer end portion of the lance is to achieve very high rates of heat transfer over that section of the lance which is submerged in the bath to ensure adequate cooling to preserve the coating of solidified slag. The high exit velocity also helps to disperse the gases entering the bath. When a swirler is employed, the gases also acquire lateral momentum which prevents excessive penetration of gas bubbles below the tip of the lance. In cases where no swirl is imparted to the gases, lateral momentum may be imparted by flaring the lower end of the inner tubular member at the open end of the annular duct 3. In cases where it is intended to use the lance in a strongly reduced slag bath, e.g., in zinc slag fuming, the majority of the coal is used as fuel while the remainder (typically one-quarter to one-third of the total coal) serves as reductant in the bath. The fraction which is used as fuel must be finely divided typically 100% minus 75 micrometer, in order to achieve good combustion in the flame at the tip of the lance. The fraction which is used as reductant may vary in size up to the largest size which may be transported through the delivery tube into the gas stream. Alternatively, this fraction may be charged as lumps onto the surface of the bath. The coal fraction which is used as fuel should also have a sufficiently high volatile content (typically greater than 10%) so that it ignites rapidly in the burning zone.

Where the lance is intended for use in an oxidative smelting system such as copper smelting, direct lead smelting or nickel smelting, the requirement for rapid combustion is not severe. The coal need only be reduced in size to the extent necessary to allow it to be transported to the combustion zone of the lance. The reason for this is that a bath containing a matte and/or slag phase acts as a very efficient oxygen carrier, so that the bath may be over-oxidised by excess unreacted air at the tip of the lance and subsequently reduced by the injected coal particles as they are mixed into the bath by the turbulence induced by the injected gases.

Further embodiments of the invention will now be described with reference to the following Examples. These examples are not to be construed as limiting the invention in any way.

EXAMPLE 1

Smelting slag at 60 kg/h with gas as fuel at 60% $O_2$ at 1300°–1350° C. and also at 1400°–1450° C.

The furnace was preheated to 1250° C. then a lance was lowered into the furnace. The lance comprised three concentric stainless steel tubes, a 25.4 mm outside diameter tube of wall thickness of 1.6 mm, an inner fuel tube 15.8 mm outside diameter and wall thickness 1.6 mm and a central oxygen tube 6 mm outside diameter with a 0.8 mm wall. The upper end of the lance was fitted with connections which provided attachments for air, natural gas and oxygen supplies. At the lower end a double start swirler of 55 mm pitch was fitted over 150 mm of the fuel tube, terminating 50 mm from the end. The oxygen tube extended 10 mm past the end of the fuel tube which itself was within 30 mm of the end of the lance outer tube.

A molten slag bath was prepared by lowering the lance and melting slag in the vessel by impinging hot combustion gases from the lance on the surface—slag was added until a sufficient depth of molten slag was obtained to allow immersion of the lance into the bath. The lance was lowered until the tip was just above the slag surface and remained there until a protective layer of slag coated the lance outer tube after which period the lance was immersed into the molten slag.

Granulated slag was fed continuously to the furnace at 50 kg/h for 15 minutes, the oxygen content was increased to 50% with an oxygen flow rate of 18 $Nm^3/h$ and air flow rate of 31 $Nm^3/h$—the natural gas rate was 13.1 $Nm^3/h$.

After this period the slag feed rate was increased to 60 kg/h and maintained at that rate for 55 minutes.

The oxygen content was increased to 60% with air flow rate of 28 $Nm^3/h$, oxygen flow of 26 $Nm^3/h$ and natural gas rate of 16.9 $Nm^3/h$. The temperature was maintained at 1300°–1350° C. by applying a heat load of 51.8 Mjoules to the furnace.

After reaching furnace capacity the lance was raised and inspection of the lance tip showed minimal surface attack.

At this point approximately 60 kg of slag was tapped from the furnace and smelting continued with 60 kg/h of slag with air flow rate of 28.2 $Nm^3/h$, oxygen flow of 26 $Nm^3/h$ and gas rate of 16.9 $Nm^3/h$—again a heat load of 34 Mjoules was applied to maintain the temperature at 1400°–1450° C. for 1 hour after which the slag was poured from the furnace into moulds. Inspection of the tip showed that it eroded only a few millimeters.

EXAMPLE 2

Testing lance materials—Type 304 S.Steel, 253 MA and Chromed steel in slag at 1300°–1400° C. at 60%, 65% and 70% oxygen enrichment A 60 kg molten slag bath was prepared and the lance configuration and dimensions of Example 1 were employed.

In the first trial, a lance with an outer tube of type 304 stainless steel was splash coated in accordance with the method. The lance was then immersed into the bath and the oxygen enrichment set at 60% oxygen, the air flow set at 27.7 $Nm^3/h$, gas rate of 17.7 $Nm^3/h$ and oxygen rate of 26.5 $Nm^3/h$ and the temperature was maintained at 1300°°–1400° C. by imposing a heat load of 68 Mjoule on the furnace after 30 minutes the oxygen enrichment increased to 65% oxygen, the air flow maintained at 27.7 $Nm^3/h$ and increases in the gas to 21.0 $Nm^3/h$ and oxygen 34.0 $Nm^3/h$ respectively, the temperature was maintained at 1300°–1400° C. by increasing the heat load to 114 Mjoule. The lance was raised after 30 minutes and inspection of the tip showed about 10 mm of the outer had eroded. The lance was again splash coated and then lowered into the slag and the oxygen enrichment increased to 70% oxygen, the air flow maintained at 27.7 $Nm^3/h$ and increases in the gas to 25.1 $Nm^3/h$ and oxygen to 41.8 $Nm^3/h$ respectively, the temperature was again maintained at 1300°–1400° C. by increasing the heat load to 206 Mjoule. The lance was raised after 30 minutes and inspection of the tip showed no further erosion.

In the second trial, the lance outer tube was replaced with a type 304 stainless steel which had been hard chrome plated. The lance was again splash coated in accordance with the method and the tip immersed into the slag bath. The lance was then immersed into the bath and the oxygen enrichment set at 60% oxygen, the air flow set at 27.7 $Nm^3/h$, gas rate of 17.7 $Nm^3/h$ and oxygen rate of 26.5 $Nm^3/h$ and the temperature was maintained at 1250°–1400° C. by imposing a heat load of 68 Mjoule on the furnace after 30 minutes the oxygen enrichment increased to 65% oxygen, the air flow maintained at 27.7 $Nm^3/h$ and increases in the flow rates of gas to 21.0 $Nm^3/h$ and oxygen to 34.0 $Nm^3/h$ respectively, the temperature was maintained at 1300°–1400° C. by increasing the heat load to 114 Mjoule. The lance was raised after 30 minutes and inspection of the tip showed it had eroded back to an equilibrium distance from the oxygen tube (ie a distance of 10 mm). The lance was again splash coated and then lowered into the slag and the oxygen enrichment increased to 70% oxygen, the air flow maintained at 27.7 $Nm^3/h$ and increases in the gas to 25.1 $Nm^3/h$ and oxygen to 41.8 $Nm^3/h$ respectively, the temperature was again maintained at 1300°–1400° C. by increasing the heat load to 206 Mjoule. The lance was raised after 30 minutes and inspection of the tip showed no further erosion.

EXAMPLE 3

Copper smelting at 50 kg/h with natural gas fuel with 60% oxygen enrichment at 1300°–1400° C.

The lance configuration and dimensions of Example 1 were employed. The furnace was preheated to 1300° C. then a lance was lowered into the furnace and a 40 kg molten slag bath was prepared as in Example 1.

The lance was then lowered until the tip was just above the slag surface where it remained until a protective layer of slag coated the lance outer tube, after which period the lance was immersed into the molten slag.

Copper concentrate pellets were then fed continuously to the furnace at 50 kg/h for 35 minutes with the oxygen enrichment controlled at 50% with an oxygen flow rate of 36 $Nm^3/h$ and air flow rate of 37 $Nm^3/h$—the natural gas rate was 15.9 $Nm^3/h$. After this period the enrichment was increased to 60% oxygen and maintained at that level for 2 hours. The air flow rate was set at 37 $Nm^3/h$, oxygen flow of 36.1 $Nm^3/h$ and natural gas rate of 15.9 $Nm^3/h$. The temperature was maintained at 1300°–1350° C. by applying a heat load of 147–188 Mjoules to the furnace.

After reaching furnace capacity the lance was raised and the furnace contents tapped into moulds. Inspection of the lance showed minimal surface attack and about 3 mm erosion of the tip.

The same lance inner tubes were used for all the examples and the type 304 stainless steel lance outer tube was also used in Example 1, the first trial in Example 2 and in this example.

In the third, trial the lance outer tube was replaced with a type 253MA steel sheath with the tip set back 10 mm from the oxygen tube. The lance was again splash coated in accordance with the method and the tip immersed into the slag bath. The lance was then immersed into the bath and the oxygen enrichment set at 60% oxygen, the air flow set at 27.7 $Nm^3/h$, gas rate of 17.7 $Nm^3/h$ and oxygen rate of 26.5 $Nm^3/h$ and the temperature was maintained at 1300°–1400° C. by imposing a heat load of 68 Mjoule on the furnace after 30 minutes the oxygen enrichment increased to 65% oxygen, the air flow maintained at 27.7 $Nm^3/h$ and increases in the gas to 21.0 $Nm^3/h$ and oxygen 34.0 $Nm^3/h$ respectively, the temperature was maintained at 1300°–1400° C. by increasing the heat load to 114 Mjoule. The lance was raised after 30 minutes and inspection of the tip showed toughening of the tip but no significant erosion. The lance was again splash coated and then lowered into the slag and the oxygen enrichment increased to 70% oxygen, the air flow maintained at 27.7 $Nm^3/h$ and increases in the gas to 25.1 $Nm^3/h$ and oxygen to 41.8 $Nm^3/h$ respectively, the temperature was again maintained at 1300°–1400° C. by increasing the heat load to 206 Mjoule. The lance was raised after 30 minutes and inspection of the tip showed no further erosion.

EXAMPLE 4

Smelting slag at 50 kg/h with pulverised coal as fuel with 60% $O_2$ enrichment at 1300°–1350° C.

The lance configuration and dimensions of Example 1 were employed. The furnace was preheated to 1300° C. then a molten slag bath (40 kg) was prepared by lowering the lance and melting slag in the vessel by impinging the hot combustion gases from the lance on the top surface—natural gas was used as fuel at a rate 13.1 $Nm^3/h$, air flow rate of 46 $Nm^3/h$ and oxygen flow rate of 14.8 $Nm^3/h$.

Slag was added until a sufficient depth of molten slag was obtained to allow immersion of the lance into the bath.

The lance was splash coated according to the method then immersed into the molten slag.

Granulated slag was fed continuously for 20 minutes to the furnace at 50 kg/h, the oxygen enrichment was controlled at 50% with an oxygen flow rate of 22.5 $Nm^3/h$ and air flow rate of 38.9 $Nm^3/h$ and the pulverised coal fuel rate was 20 kg/h. The oxygen enrichment was increased to 60% for a further 80 minutes with an oxygen flow rate of 25.2 $Nm^3/h$, air flow rate of 26 $Nm^3/h$ and pulverised coal rate of 20 kg/h and the temperature was maintained at 1300°–1350° C. by imposing a heat load of 147 Mjoule to the furnace. These conditions provided low pressure (50 kPa), non-choked flow in the lance. To demonstrate the effect of choked flow, the rates of oxygen, air and coal were then increased to 30.2 $Nm^3/h$, 31.2 $Nm^3/h$ and 24 kg/h, respectively. This led to choked flow which required a significant increase in the air pressure, to 140 kPa, to maintain the desired air flow.

After smelting slag for 2 hours the lance was lifted and the contents of the furnace poured into moulds. Inspection of the lance showed that there was no erosion of the tip of the lance.

We claim:

1. A lance for submerged injection of materials into a liquid pyrometallurgical bath, comprising an outer lengthwise extending tubular member with an outer end portion to be submersed in the bath, an inner lengthwise extending tubular member positioned within the outer tubular member, an annular duct being thereby defined between the outer and inner tubular members for conveying a gas containing oxygen to an open outer end thereof, a conduit positioned within and extending lengthwise of the inner tubular member for conveying further gas consisting of or containing oxygen to the outer end portion of the lance, a lengthwise passage being thereby defined between the inner tubular member and the conduit for conveying combustible fluid to the outer end portion of the lance, at least one port providing communication between the passage and the annular duct and at least one exit passageway providing communication between the conduit and the outer end portion of the outer tubular member at a location downstream of the port or ports, for directing the further gas flowing from the conduit into the outer end portion of the lance.

2. A lance as claimed in claim 1, characterised in that the annular duct is divided near the open outer end to form a plurality of duct portions.

3. A lance as claimed in claim 2, characterised in that the plurality of duct portions is provided by at least two radial baffles extending between the inner and outer tubular members.

4. A lance as claimed in claim 3, characterised in that the at least two radial baffles are in spiral form thereby to impart swirl to the gas flowing within the annular duct.

5. A lance as claimed in claim 4, characterised in that the swirl angle of each radial baffle is such that choked flow is avoided and low pressure operation is attained.

6. A lance as claimed in claim 4, characterised in that the swirl angle of each radial baffle is such that the helical velocity does not exceed Mach 0.9.

7. A lance as claimed in claim 1 characterised in that the inner tubular member has an enlarged portion.

8. A lance as claimed in claim 7, characterised in that the enlarged portion is located towards the outer end of the inner tubular member.

9. A lance as claimed in claim 1, characterised in that the inner and outer tubular members are coaxial.

10. A lance as claimed in claim 1, characterised in that the conduit is coaxial with the inner tubular member.

11. A lance as claimed in claim 1, characterised in that the dimension of the annular duct is such that the desired gas flow rate can be achieved at a low supply pressure.

12. A lance as claimed in claim 1, characterised in that an atomising nozzle is provided in at least one port so as to deliver liquid fuel through the lengthwise passage.

13. A lance as claimed in claim 1, characterised in that the lance is composed of steel.

14. A lance as claimed in claim 1, characterised in that the outer end of the inner tubular member terminates at a location in the range from 1 m inside the outer open end of the outer tubular member to a distance beyond the end of the outer tubular member equal to twice the diameter of the outer tubular member.

15. A lance as claimed in claim 1, characterised in that the lengthwise passage is terminated by a closure or a partial closure.

16. A lance as claimed in claim 15, characterised in that the closure has a frusto-conical upper surface to assist gas flow from the lengthwise passage into the annular duct.

17. A lance as claimed in claim 16, characterised in that the port or ports is/are located substantially adjacent the frusto-conical upper surface.

18. A lance as claimed in claim 17, characterised in that the port or ports is/are angled so as to correspond with an angle of the frusto-conical upper surface.

19. A lance as claimed in claim 15, characterised in that the closure has a further frusto-conical surface portion at its lower end which projects across the open outer end of the annular duct at a location below the end of the outer tubular member.

20. A lance as claimed in claim 15, characterised in that the conduit extends through the closure so as to provide for outflow of gas through the open end of the conduit as well as or instead of through the at least one exit passageway.

21. A lance as claimed in claim 1, characterised in that the or each port comprises a hole or a slot.

22. A lance as claimed in claim 1, characterised in that there is more than one port and said ports are spaced around the circumference of the inner tubular member.

23. A lance as claimed in claim 1, characterised in that at least one port is located substantially within 1000 mm open outer end of the annular duct.

24. A lance as claimed in claim 1, characterised in that there is more than one exit passageway and these are spaced around the circumference of the conduit.

25. A lance as claimed in claim 1, characterised in that the exit passageway opens into the annular duct at a location not more than substantially three times the inner diameter of the outer tubular member upstream from the open outer end of the annular duct.

26. A lance as claimed in claim 1, characterised in that the outer end portion of the lance to be submerged in the comprises stainless steel.

27. A lance as claimed in claim 1 including at least one radial baffle extending between the inner and outer tubular members, the or each baffle being in spiral form.

28. A lance as claimed in claim 1, for immersion into a liquid pyrometallurgical bath, comprising an outer tubular member, an inner tubular member which is concentric with the outer tubular member, a conduit being located within the inner tubular member, an annulus being defined between the outer and inner tubular members, said annulus being open at an outer end thereof and through which air flows at a sufficiently high flow rate and velocity past an inner surface of the outer tubular member to cool the outer tubular member and to cause a protective layer of the liquid in the bath to solidify on said outer tubular member, the annulus being divided near the open outer end into a plurality of ducts by means of at least two radially extending baffles.

29. A method for submerged injection of materials into a liquid pyrometallurgical bath by means of a lance as claimed in claim 1, comprising the steps of: (a) conveying a first gas containing oxygen to said bath along a first path within the lance; (b) conveying a combustible fluid to said bath along another path within the lance; and (c) conveying a further gas containing at least 35% oxygen to said bath along a further path within the lance, the first path being arranged so that the first gas acts as a coolant for the lance.

30. A method for injecting materials into a liquid pyrometallurgical bath, comprising the steps of:

(a) positioning a lance comprising an outer lengthwise extending tubular member with an outer end portion to be submerged in the bath, an inner lengthwise extending tubular member positioned within the outer tubular member, an annular duct being thereby defined between the outer and inner tubular members for conveying a gas containing oxygen to an open outer end thereof, a conduit positioned within and extending lengthwise of the inner tubular member for conveying further gas consisting of or containing oxygen to the outer end portion of the lance, a lengthwise passage being thereby defined between the inner tubular member and the conduit for conveying combustible fluid to the outer end portion of the lance, at least one port providing communication between the passage and the annular duct and at least one exit passageway providing communication between the conduit and the outer end portion of the outer tubular member at a location downstream of the port or ports, for directing the further gas flowing from the conduit into the outer end portion of the lance so that the outer end portion of the lance is submerged in the bath and passing the gas containing oxygen, the further gas consisting of or containing oxygen and the combustible fluid along the lance, through the annular duct, the conduit and the lengthwise passage respectively to exit at the outer end portion of the lance.

31. A method as claimed in claim 30 wherein the dimension of the annular duct is such that the desired gas flow rate can be achieved at a low supply pressure.

32. A method as claimed in claim 31 wherein the supply pressure does not exceed 100 kPa.

33. A method as claimed in claim 31 wherein the supply pressure is raised to achieve choked operation in which the helical velocity reaches Mach 1.

34. A method as claimed in claim 30 wherein oxygen is delivered through the conduit near the open outer end of the annular duct so as to achieve "turn-up".

* * * * *

UNITED STATES PATENT AND TRADEMARK OFFICE

CERTIFICATE OF CORRECTION

PATENT NO. : 5,505,762

DATED : April 9, 1996

INVENTOR(S) : William T. DENHOLM et al.

It is certified that error appears in the above-indentified patent and that said Letters Patent is hereby corrected as shown below:

On the title page:

ITEM [73] Assignee:

Change Campbell, Australia to Campbell, Australian Capital Territory, Australia

Signed and Sealed this

Third Day of December, 1996

*Attest:*

BRUCE LEHMAN

*Attesting Officer*

*Commissioner of Patents and Trademarks*